US005522538A

United States Patent [19]

Gray

[11] Patent Number: 5,522,538

[45] Date of Patent: Jun. 4, 1996

[54] CARTON AND BLANK WITH LOCKING TOP

[75] Inventor: Larry D. Gray, Chesterfield, Va.

[73] Assignee: Westvaco Corporation, New York, N.Y.

[21] Appl. No.: 370,092

[22] Filed: Jan. 9, 1995

[51] Int. Cl.[6] ..... B65D 5/24

[52] U.S. Cl. ..... 229/112; 229/149; 229/165; 229/186

[58] Field of Search ..... 229/112, 120.18, 229/120.21, 125.28, 149, 165, 169, 186

[56] References Cited

U.S. PATENT DOCUMENTS

| | | | |
|---|---|---|---|
| 3,125,279 | 3/1964 | Watts et al. | 229/149 |
| 3,178,092 | 4/1965 | Munana et al. . | |
| 3,309,005 | 3/1967 | Pilger | 229/112 |
| 3,542,569 | 11/1970 | Farquhar . | |
| 4,022,372 | 5/1977 | Graser | 229/186 X |
| 4,105,155 | 8/1978 | Forbes, Jr. | 229/112 X |
| 4,245,711 | 1/1981 | Christian . | |
| 4,428,525 | 1/1984 | Brauner | 229/112 X |
| 4,516,718 | 5/1985 | Forbes, Jr. . | |
| 4,607,786 | 8/1986 | Weaver | 229/149 X |
| 4,763,832 | 8/1988 | Forbes, Jr. . | |
| 4,765,533 | 8/1988 | Hoshiko . | |

FOREIGN PATENT DOCUMENTS

| | | | |
|---|---|---|---|
| 1666379 | 7/1991 | U.S.S.R. | 229/112 |

*Primary Examiner*—Allan N. Shoap
*Assistant Examiner*—Christopher J. McDonald

[57] ABSTRACT

A carton for a food product or the like is prepared from a pre-cut and scored single blank of paperboard with a provision for a locking top closure and self-erecting rhombic shaped end panels. The rhombic shaped end panels include integral connector panels and paired intermediate end panels, at least one pair of which are adhered to a side wall of the carton to assist in the self-erection of the carton as it is folded from a flat pre-formed condition to an upright fully formed condition.

1 Claim, 2 Drawing Sheets

CARTON AND BLANK WITH LOCKING TOP

BACKGROUND OF INVENTION

The present invention relates to a disposable carton for food products or the like and more particularly to a carton for carryout food products.

The manufacture of disposable food cartons, particularly for the fast food industry, involves highly developed technology. Such cartons must be designed for maximum economy and utility with emphasis on ease of use, cost effectiveness, handling, filling and closing. Product identification, storage of cartons for end use, and integrity after being filled are also important. When such cartons are to be used for packaging hot foods, design considerations must be incorporated into the carton structure to provide a quick and easy means for loading and closing the carton to keep the food hot, and for retaining the lids closed until the food is to be served.

Cartons of the type discussed above often take the form of clam shell type structures particularly as disclosed in U.S. Pat. Nos. 4,516,718 and 4,763,832, owned by the present assignee herein. Other related food cartons may take the form shown in U.S. Pat. Nos. 3,542,569 and 4,765,533. However, when there is a desire to package more than a single sandwich in a carton, and particularly a complete entree with extras, such cartons must include extra space and be designed so as to provide complete access to the contents. For this purpose, the carton design of the present invention is generally trapezoidal in shape and is conveniently prepared from a single blank of paperboard or the like.

Trapezoidal shaped containers are not new, as shown by U.S. Pat. No. 3,178,092 and 4,245,771, however, these prior art patented constructions do not possess the relative simplicity and economy of the present invention.

SUMMARY OF INVENTION

Accordingly, the present invention comprises a food carton having a trapezoidal shaped cross-section including a bottom panel and foldably connected front and rear panels, with opposed rhombic shaped end panels. The end panels are also foldably attached to the bottom panel, and include integral abbreviated sections connected to the end panels by connector panels which are further foldably connected to the front and rear panels. Finally, the front and rear panels also include overlapping interior and exterior closure flaps which include a double articulated locking tab and a pair of locking slots. All of these features are included in a single blank of cut and scored paperboard with a minimum of only one glue step to produce a carton that is readily set-up and erected for use. In addition, the carton the present invention is readily opened so that it can serve as a convenient tray for serving the food products and thereafter be disposed of as a self contained trash or leftover receptacle. These and other objects will become apparent to those skilled in the art from the drawings and detailed description.

BRIEF DESCRIPTION OF DRAWING

The accompanying drawings show an exemplary embodiment of the present invention, in which.

DETAILED DESCRIPTION

Figure 1:
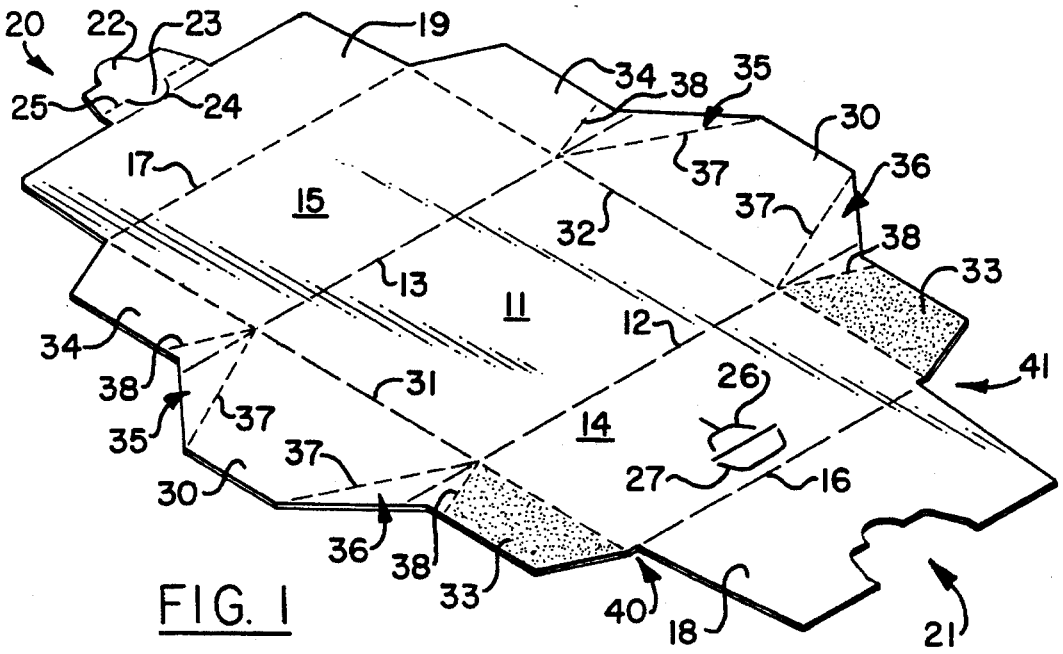
FIG. 1 is a perspective view illustrating a typical blank structure for forming the carton of the present invention.

With particular reference to FIG. 1 of the drawing, the blank 10 is comprised of a substantially symmetrical structure including a centrally located bottom panel 11 hingedly connected along fold lines 12 and 13 to first and second side panels 14 and 15. Side panel 14 is additionally hingedly connected to an interior closure flap 18 along a fold line 16, and side panel 15 is hingedly connected to an exterior closure flap 19 along a fold line 17. Each of the fold lines 12, 13, 16 and 17 are substantially parallel to one another and are generally perpendicular to the longitudinal centerline of the blank. In addition, closure flap 18 has a width along fold line 16 that is slightly shorter than panel 14 to provide inset notches 40, 41 at each corner. Closure flap 19 includes at the outer edge thereof an articulated carton locking tab structure referred to generally by reference character 20, and the interior closure flap 18 includes a cut-out area 21 at its outer edge of the same general shape as the carton locking tab structure 20. This configuration is conventional and allows separate carton blanks 10 to be cut end-to-end from a sheet of paperboard or the like in a nested condition with a minimum amount of waste. Meanwhile, the locking tab structure 20 is of the double articulated type which provides in effect two locking elements 22, 23 in reverse orientation. In the preferred embodiment shown, locking element 22 is comprised of an exterior extension of tab 20 and locking element 23 is an integral part of tab 20 formed therefrom by cut line 24 and hinged to tab 20 by score line 25. The locking tab 20 is preferably centrally located along the edge of exterior closure flap 19 with respect to the longitudinal centerline of the blank 10. In this manner, the locking elements 22, 23 are in good alignment with the locking slots 26, 27 located in side panel 14 for cooperative engagement in locking a carton made from the blank 10 in the closed condition.

Also shown in FIG. 1, are a pair of rhombic shaped end panels 30, 30 foldably connected to the bottom panel 11 along longitudinal fold lines 31, 32, each having joined thereto first and second sets of intermediate end panels 33, 33 and 34, 34 foldably connected to the first and second side panels along fold lines 31, 32. The rhombic shaped end panel 30 and adjacent intermediate panels 33, 34 at each side of the blank are foldably connected together by connector panels 35, 36 along score lines 37, 38 for a purpose to be described later. In any event, as shown in FIG. 1, at least the intermediate panels 33, 33 are preferably applied with an adhesive for completing the carton structure, with the understanding that intermediate panels 34, 34 may also include adhesive where desired.

Figure 2:
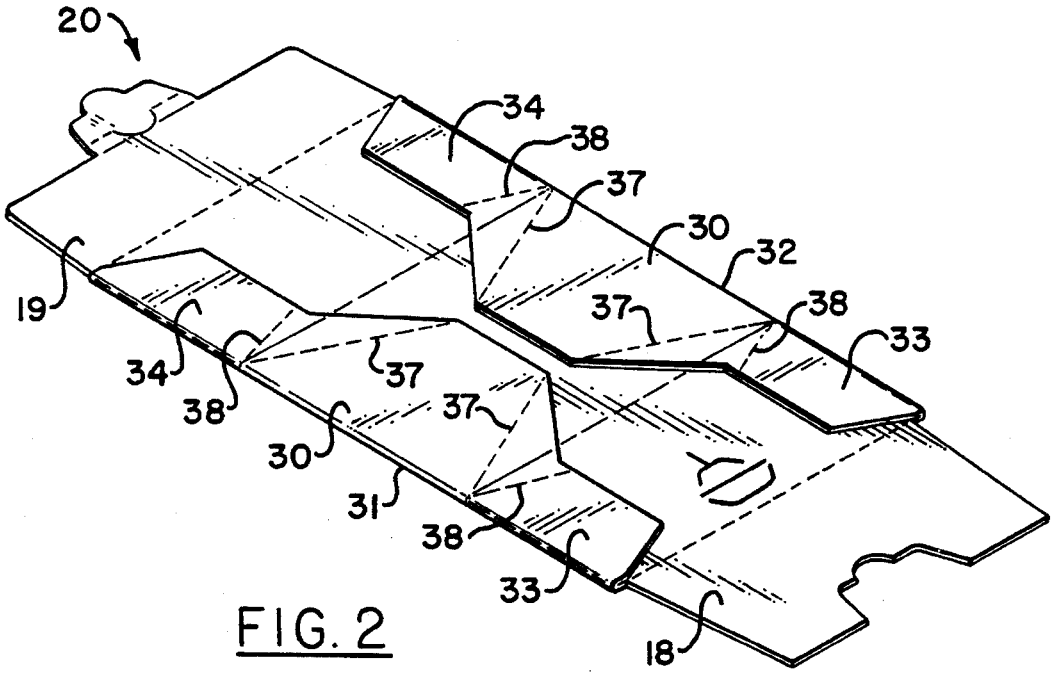
FIG. 2 is a view like FIG. 1 showing a first folding step in pre-forming the carton of the invention.

FIG. 2 shows the first folding sequence for blank 10 to partially assemble the carton structure for use. This step is accomplished by folding the interconnected rhombic shaped end panels 30, 30 and intermediate panels 33, 33 and 34, 34 over about fold lines 31, 32 so that intermediate panels 33, 33 become adhered to side panel 14. By gluing the intermediate panels 33, 33 (and, if required 34, 34), to the primary blank structure, these panels remain inside when the carton is formed. Accordingly, as long as the blank remains flat as shown in FIG. 2, the end panels 30 and their intermediate panels 33, 34 each lie substantially flat against the primary blank structure. However, when the side panels 14 and 15 are folded upwardly about scored lines 12 and 13 to form an enclosure, the scoring scheme for connector panels 35, 36, at each side of the two end panels 30, is designed to cause the two end panels to rise into a configuration substantially as shown in FIG. 3.

Figure 3:
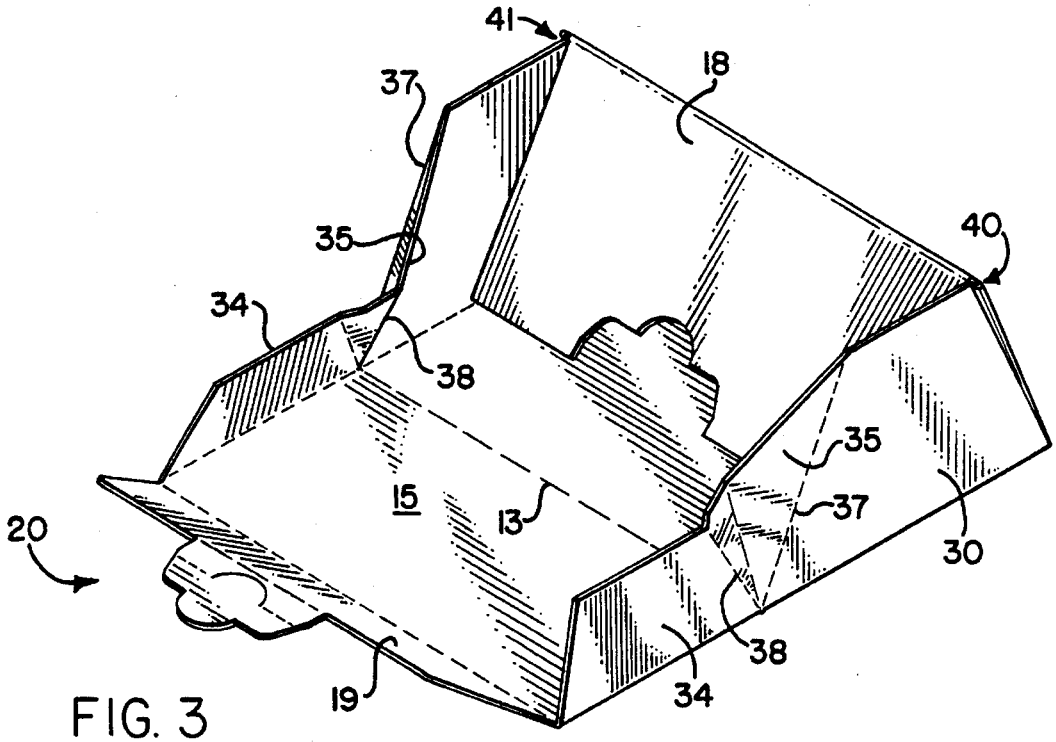
FIG. 3 is a perspective view of the carton in a partially set-up condition.

Note for example in FIG. 3 that the notches 40, 41 at each side of flap 18 allow the carton to be retained in its partially erected condition by folding closure flap 18 slightly downward about fold line 16 between end panels, 30, 30. Meanwhile, as side panel 15 is folded upwardly about score line 13, connector panels 35, 35 between rhombic panels 30, 30 and intermediate panels 34, 34 fold inwardly about score line 37 and outwardly about score line 38. The end result is that because of the location and orientation of the score lines 37, 38, the connector panels, 35, 35 end up lying adjacent and in close proximity to the side panel 15 when the carton is closed, and likewise, the connector panels 36, 36 assume a similar position adjacent and in close proximity to the side panel 14. Thus, the connector panels 35, 35 and 36, 36 play an essential role in erecting the end panels 30, 30 of the carton as it is formed beginning with the initial folding sequence shown in FIG. 3.

Figure 4:
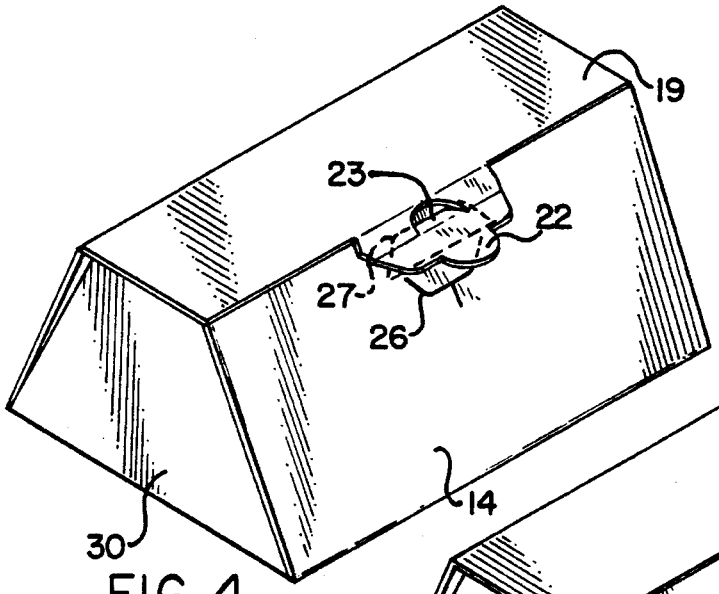
FIG. 4 is a perspective view of the closed carton with the locking closure in a position to be engaged; and, FIG. 5 is a view like FIG. 4 with the locking closure secured.
Figure 5:
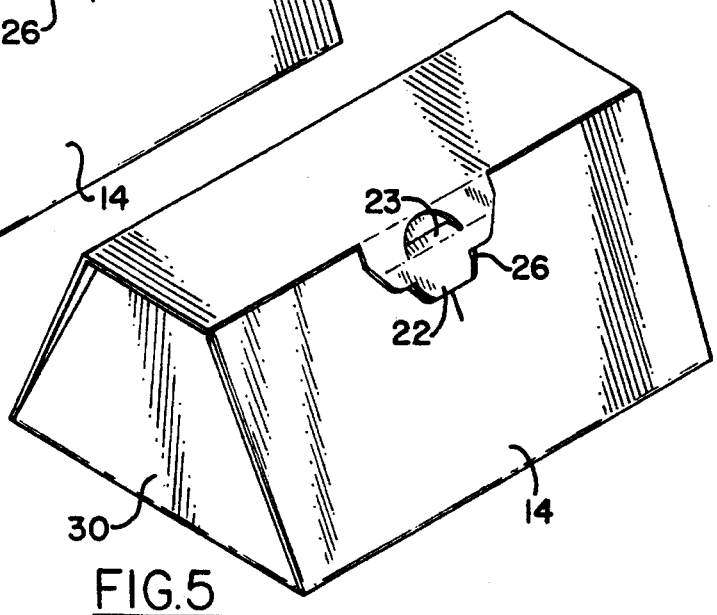

After the carton is fully erected as shown in FIG. 4, the locking tab 20 is first folded upwardly to cause locking element 23 to become inserted in locking slot 27, then the tab 20 is folded downwardly to allow locking element 22 to be inserted in locking slot 26. This manipulation of locking tab 20 provides a positive double lock for the carton with the exterior closure flap 19 lying on top of interior closure flap 18. To provide access to the carton contents, the folding sequence described above is reversed by first releasing locking element 22 from slot 26, and then, after folding the locking tab 20 upwardly, the locking element 23 can be released from slot 27. The carton can then be opened merely by folding back the interior and exterior closure flaps 18, 19 to reveal the contents.

As described above, the carton according to the present invention can be manufactured inexpensively since it is formed from a single piece of paperboard which requires a minimum of only one gluing operation. Furthermore, the carton structure may be stored in a flattened pre-folded condition before use, and then readily set-up for use with a minimum of effort. Thus, while the invention has only been shown and described with reference to a specific embodiment, it should be noted that the invention is in no way limited to the details of construction illustrated and described. Accordingly, changes and modifications may be readily made without departing from the scope of the appended claims.

What is claimed is:

1. An erectable container capable of being retained in a partially erected condition having a trapezoidal cross-section formed from a single blank of foldable material comprising:

(a) front, bottom and rear panels connected to one another along parallel fold lines;

(b) a pair of opposed rhombic shaped end panels foldably attached to said bottom panel;

(c) opposed pairs of abbreviated end flaps foldably attached to each of said front and rear panels wherein at least one pair of said opposed abbreviated end flaps is adhered to one of said front or rear panels;

(d) connector panels integral with and foldably attached between the .end panels and abbreviated end flaps;

(e) overlapping interior and exterior closure flaps foldably connected respectively to one each of said front and rear panels;

(f) a locking means between said exterior closure flap and one of said front or rear panels comprising a locking tab foldably attached to the exterior closure flap consisting of a first locking element and a reverse second locking element cut from a portion of said locking tab, and locking slots formed in one of said front or rear panels consisting of a first locking slot and a second reverse locking slot each formed in said front or rear panel to provide a positive double articulated lock for the container in reverse orientation; and, (g) a pair of inset notches formed at each corner of the interior closure flap along the fold line between said interior closure flap and one of said front or rear panels which permits the interior closure flap to be folded downwardly between said rhombic shaped end panels during the erection of the container to keep the container partially erected for filling and serving.

* * * * *